US005344329A

United States Patent [19]

Faller

[11] Patent Number: 5,344,329

[45] Date of Patent: Sep. 6, 1994

[54] PLUG-IN SOCKET WITH BLOCKING MEMBER

[76] Inventor: Enzo Faller, Wilhelm-Strater-Str. 3, D-4050 Mönchengladbach 2, Fed. Rep. of Germany

[21] Appl. No.: 926,002

[22] Filed: Aug. 5, 1992

[30] Foreign Application Priority Data

Aug. 12, 1991 [DE] Fed. Rep. of Germany ..... 9109960
Nov. 22, 1991 [DE] Fed. Rep. of Germany ..... 9114540

[51] Int. Cl.[5] ..... H01R 13/44

[52] U.S. Cl. ..... 439/133; 70/57; 70/168

[58] Field of Search ..... 439/133; 70/14, 161, 70/162, 167, 168, 169, 57, 58, DIG. 72

[56] References Cited

U.S. PATENT DOCUMENTS 1,434,492 11/1922 Johnson ..... 70/161
1,544,951 7/1925 Sollee ..... 70/168
1,878,436 9/1932 Burroughs ..... 70/168
2,987,909 5/1961 Shlank ..... 70/168
4,893,488 1/1990 Klein ..... 439/133
4,964,284 10/1990 McDaid ..... 439/133
4,975,550 12/1990 Panchisin ..... 439/133
5,190,466 3/1993 McVey ..... 439/133

FOREIGN PATENT DOCUMENTS 814247 9/1951 Fed. Rep. of Germany ..... 70/167

*Primary Examiner*—Neil Abrams
*Attorney, Agent, or Firm*—Meltzer, Lippe, Goldstein, Wolf, Schlissel & Sazer

[57] ABSTRACT

A plug-in socket for amplifiers, loudspeaker boxes, electric musical instruments etc. is described. The plug-in socket has a socket member for the introduction and holding of an electrical plug and at least two electrical contacts engageable with the plug. Furthermore, it includes a blocking member adapted to be introduced into the socket member and to be locked therein. The blocking member prevents an unauthorized introduction of an electrical plug into the socket.

3 Claims, 4 Drawing Sheets

PLUG-IN SOCKET WITH BLOCKING MEMBER

The present invention is directed to a plug-in socket for amplifiers, loudspeaker boxes, electric musical instruments etc., said plug-in socket having a plug member for the introduction and holding of an electrical plug and at least two electrical contacts which are engageable with the electrical plug.

The problem exists to protect such devices against unauthorized use since the same are often freely accessible in exhibition rooms, sound studios etc.. So, the devices can be made ready for operation at once by means of suitable connections to current sources through the introduction of plugs into the plug-in sockets provided at the devices.

Plug-in sockets of the above-described kind are used in many embodiments. Normally, they have a plug member and a housing member joining to the plug member. The plug member includes a round inner bore for the reception of a round electrical plug which, in the housing member, gets into contact with two contact clamps with monoplugs and three contact clamps with stereo plugs, wherein a locking between the plug and the contact clamps is achieved by a corresponding depression at the plug or by means of projecting portions at the contact clamps. ,The contact clamps are in connection with suitable conductors which lead out of the plug-in socket. Plug-in sockets without corresponding housing member are also known.

The present invention is based on the problem to provide a plug-in socket of the above-described kind which is protected against unauthorized use.

According to the invention this problem is solved with a plug-in socket of the cited kind by the feature that it has a lockable and removable blocking member introduced into the socket member, said blocking member preventing an unauthorized introduction of an electrical plug into the socket.

Accordingly, the inventive solution provides to block the corresponding plug-in socket by an introduced member such that a corresponding electrical plug can no more be introduced. Thus, the respective device at which the plug-in socket is located can no more be connected to a source of electric current or to a further device, so that the device can no more be made ready for operation by an unauthorized person. This is true especially for electric musical instruments which can be protected by this against unauthorized use. The lockable and removable blocking member introduced into the socket member can be unlocked by an authorized person and thereafter removed from the socket member so that a corresponding plug can be again introduced into the plug-in socket by an authorized person. Of course, only authorized persons have suitable means for unlocking the blocking member.

Preferably, the blocking member is lockable and unlockable by means of a key. In order to protect the device provided with the plug-in socket against unauthorized use, the blocking member is introduced into the socket member and locked therein by actuation of the key. If the device is to be released again for use, an unlocking is carried out by another actuation of the key, whereafter the blocking member can be pulled out of the socket member.

According to an improvement the blocking member has an actuating member and a locking member actuatable by the actuating member which, in the actuated condition, extends to a position radially outside of the bore of the socket member and prevents thereby pulling out the blocking member. Accordingly, the locking realizable by the blocking member occurs by bringing the locking member, by actuation of the actuating member, into a position radially outside of the bore of the socket member in which pulling out the blocking member from the socket member is prevented. Accordingly, if with the assistance of the key the actuating member is actuated, the locking member is displaced into the position radially outside of the bore of the socket member, and the locked condition of the blocking member is reached. Then, the key can be drawn off so that the plug-in socket is blocked for unauthorized persons. The actuating member is brought back in its initial position by again inserting the key and turning the same in a backward direction, whereby the locking member arives at its position within the bore of the socket member. Now, the blocking member can be pulled out of the plug-in socket again.

Of course, a turning step of a key is not absolutely necessary for the actuation of the actuating member; for example, the actuation can be also realized by pushing in a key or a comparable member. The corresponding unlocking is realized by drawing off the key.

It is important that the locking member is moved radially out of the socket member so far that pulling out the blocking member by certain manipulations of unauthorized persons is not possible. Since with such plug-in sockets the true socket member with corresponding bore is relative short and the housing with the plugs is behind the same, the locking member can be moved radially outwardly behind the bore of the socket member in the housing so that the locking member, when an attempt is made to pull out the blocking member, comes into contact with the step between housing and bore and thus makes impossible to pull out the same.

In accordance with an especially preferred embodiment of the invention the actuating member is disposed at the cylinder of a lock actuatable with the key and is turnable from an initial position into an actuating position by key turning, while the locking member is disposed at the lock housing. By turning the key in the lock the lock cylinder and thus the actuating member is turned into the actuating position in which the locking member, which is disposed at the lock housing, is moved radially outwardly. The key is turned in the opposite direction for unlocking the blocking member.

According to an improvement of the invention the locking member is formed as sleeve member projecting from the lock housing and being at least partially expandable. The rod-like actuating member is disposed within the sleeve member. Preferably, the expansion of the sleeve member is carried out by a rotation of the actuating member; however, it can be realized also through the introduction of the actuating member into the sleeve member, for example. So, for example, the locking member can include a bracket which is bendable off or bendable out and which is bent off or bent out by the actuating member and thus brought into a position radially outside of the bore of the sleeve member.

In order to bring the locking member into the radial outer position (straddle position) the actuating member and/or the locking member has practically a corresponding enlargement. The locking member is moved radially outwardly by the contact of the enlargement with the locking member or the actuating member. By reversed actuation of the actuating member the enlargement is removed in a position in which it does no more move outwardly or bend out, deflect or straddle the locking member so that pulling out the blocking member from the plug-in socket is possible.

Preferably, the inventive blocking member is only partially introduced into the plug-in socket in the locked condition; it is rather substantially put on the same. By this, an especially simple and comfortable actuation of the blocking member is achieved. Preferably, the lock housing is outside of the sleeve member and abuts with one end against the forward sleeve end, while the locking and actuating member are introduced into the sleeve member and extend through the same into the housing (if present).

According to a further embodiment of the invention the actuating member and the locking member are formed as single member and have a rotatable elongated element at the forward end of which a blocking portion is formed which is rotatable behind a projecting portion of the plug-in socket. The actuation of the elongated element is preferably also carried out by means of a key which is inserted into a suitable cylinder lock. By the rotation of the lock cylinder the elongated element is also rotated so that the blocking portion is brought in its blocking position engaging behind a projecting portion of the plug-in socket. The reversed process is carried out for releasing the blocking member, i.e. the key is rotated in the opposite direction, whereby the blocking portion is turned out of its blocking position. In this initial position of the blocking portion the blocking member can be again pulled out of the plug-in socket.

Preferably, the elongated element extends through a tube insertable into the plug-in socket. The tube ensures that the blocking member takes in a fixed centric position in the plug-in socket so that the blocking portion is automaticly moved in the correct position. This blocking portion is preferably formed as disk which is excentrically located at the forward end of the longitudinal element. In its non-blocking position the disk has approximately a centric position with regard to the tube and is turned out from this position for locking. Of course, the elongated element is excentrically positioned with regard to the tube and the lock cylinder.

In the following the invention is described in detail by means of embodiments in connection with the drawing. Of the drawing FIG. 1 shows a vertical section through a plug-in socket with an inserted blocking member;

Figure 1:
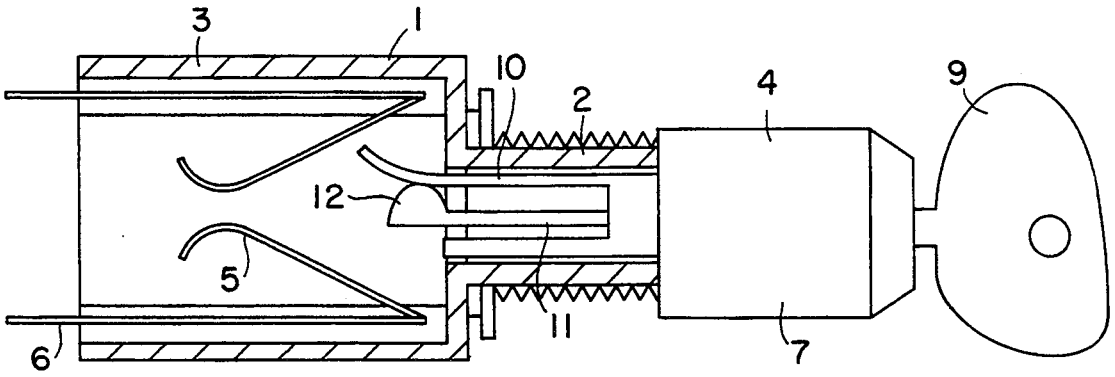

The plug-in socket 1 shown in FIG. 1 in a vertical longitudinal section has an approximately rectangular housing 3 of plastics and a sleeve member 2 extending from the housing to the right in the figure and provided with an outer thread. The sleeve member consists also of plastics. It has in its interior a bore which is circular in section and lined metallically. A usual electrical plug (not shown) having a corresponding circular portion in cross-section which is adapted to the bore of the sleeve member 2 and is received by the same in the inserted condition of the plug member is introduced into this bore. At its forward end the plug member has a tip and shortly behind the same an annular groove. When inserting the plug member into the plug-in socket 1 two metallic contact clamps 5 located in the housing 3 and extending inwardly in an inclined manner are ben t radially outwardly and spring back into the groove provided at the plug member on account of their spring action so that on the one side the plug member is locked in the plug-in socket and on the other side an electrical conduction between the plug member and the contact clamps 5 is established. When the plug member is pulled out the resistance caused by the contact clamps 5 is overcome, wherein the contact clamps move back into their initial position. The contact clamps 5 are connected to connection clamps 6 projecting from the housing 3 by means of suitable metallic lands.

Figure 2A:
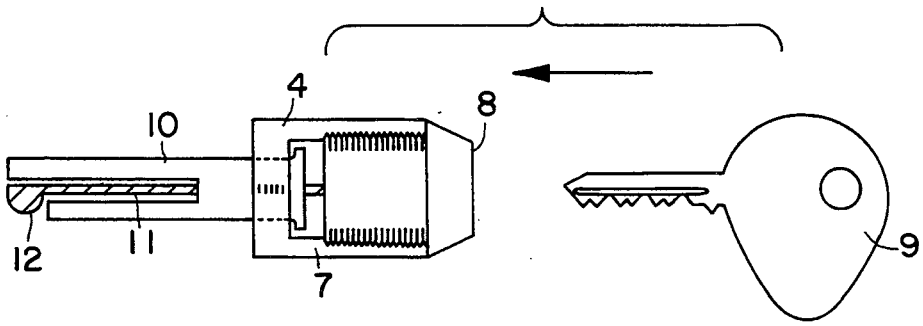
FIG. 2 shows a schematic view of a first embodiment of a blocking member without respective plug-in socket in the unlocked condition.
Figure 2B:
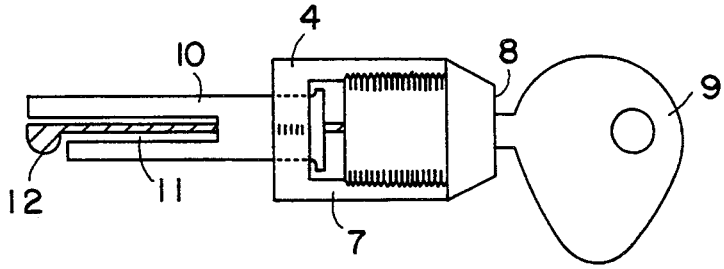
Figure 3A:
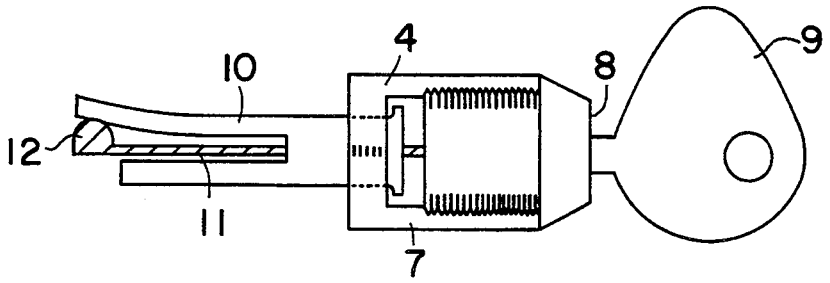
FIG. 3 shows a comparable view as FIG. 2 which, however, shows the blocking member in its locked condition.
Figure 3B:
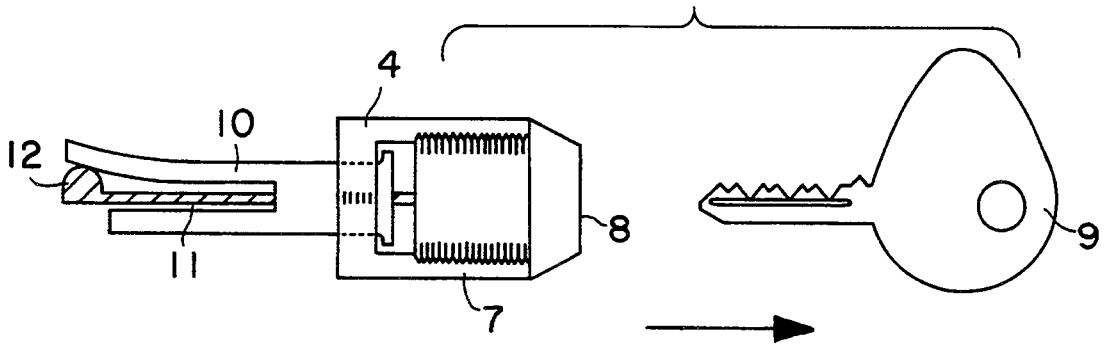

FIGS. 2 and 3 show the schematic structure of a first embodiment of a blocking member 4 which is introduceable into the plug-in socket if no plug member is within the same, in order to protect the plug-in socket against an unauthorized use. According to this embodiment the blocking member 4 is formed in a lock-like manner and includes an approximately cylindrical lock housing 7 in which a lock cylinder 8 is rotatably disposed. The actuation of the lock cylinder is realized by means of a key 9 which is insertable into a suitable key opening in the lock cylinder. When the web of the key is in the block cylinder, the lock cylinder and a rod-like actuating member 11 located in the extension of the same and connected to the lock cylinder can be rotated by turning the key. The actuating member 11 extends through a forward opening in the lock housing 7 and is enclosed by a sleeve-like locking member 10 attached to the lock housing 7. The sleeve-like locking member 10 is slotted in its left end portion in the figure. The lower portion of the locking member generated thereby is shorter than the corresponding upper portion. An enlargement 12 at the forward end of the rod-like actuating member extends into the free space generated thereby.

FIG. 3 shows that the lock cylinder and thus the rod-like actuating member 11 are rotated by turning the key. By this, the enlargement 12 is moved into an upper position and pushes thereby the upper portion of the resilient sleeve-like locking member 10 upwardly. As FIG. 1 shows, in this position the upper portion of the locking member 10 is in a position radially outside of the bore of the socket member 2 so that the blocking member 4 can no longer be removed from the plug-in socket without turning back the lock cylinder.

Figure 4A:
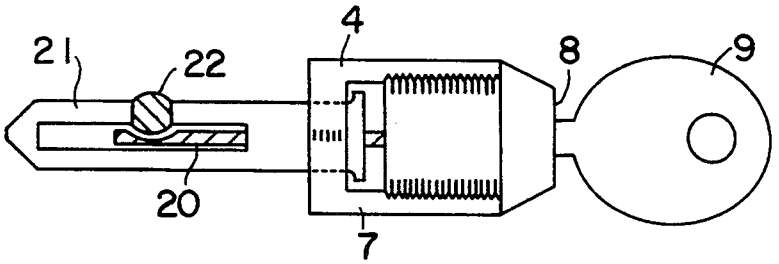
FIG. 4 shows a schematic view of a further embodiment of a blocking member in its unlocked and locked condition, also without an associated plug-in socket.
Figure 4B:
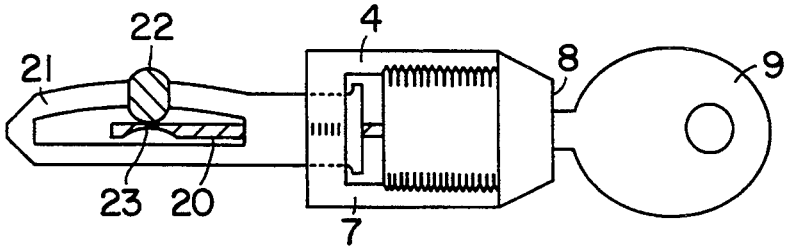

FIG. 4 shows a further embodiment of a blocking member 4. Apart from the actuating member and the locking member this has the same structure as the blocking member shown in FIGS. 1 to 3. Accordingly, it is desisted from an additional description of identical parts. The function is also similar. The rod-like actuating member 20 has a recess 23 in its forward portion in which an enlargement 22 of a sleeve-like locking member 21 rests in the non-actuated condition. This sleeve-like locking member 21 has, similar to the embodiment of FIGS. 1 to 3, a slot in its forward portion whereby a portion is generated which can be resiliently bent out. By turning the key 9 with the corresponding lock cylinder 8 the actuating member 20 is rotated about 180° so that the enlargement 22 moves out of the recess 23 and is brought in contact with the smooth opposite surface of the locking member 21. By this, the upper portion of the locking member 21 is bent outwardly, that is again into a position radially outside of the bore of the socket member so that also with this embodiment in this position the blocking member 4 cannot be pulled out from the plug-in socket.

Figure 5A:
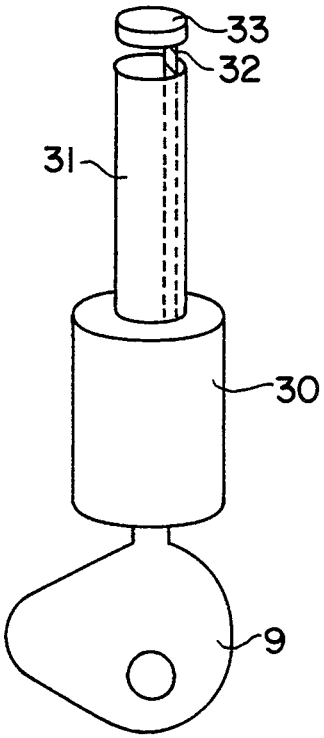
FIG. 5 shows a schematic view of still another embodiment of a blocking member in its unlocked and locked condition, also without associated plug-in socket.
Figure 5B:
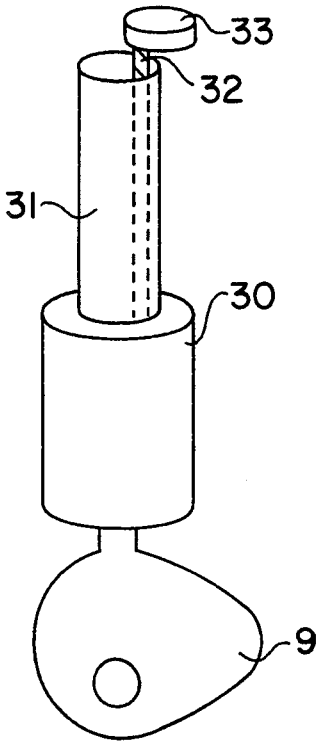

FIG. 5 shows a further embodiment of the invention. Here, only the blocking member without corresponding plug-in socket is shown either. According to this embodiment the blocking member 30 has a suitable cylinder lock with lock cylinder which can be actuated by means of a key 9 in a known manner. By turning the key 9 and thus the lock cylinder an elongated element 32 connected to the lock cylinder and excentrically located thereon is rotated. This elongated element has on its forward end a blocking portion 33 in the form of a disk which is again excentrically located at the elongated element. The elongated element 32 extends through a tube 31 centrally located at the lock. The tube serves as guide member and fixing member of the blocking member in the plug-in socket.

The left view in FIG. 5 shows the blocking member in the unlocked condition. The blocking member is introduced into the plug-in socket in this condition, wherein the tube 31 engages corresponding portions of the plug-in socket. If the plug-in socket is to be locked now, the key 9 is turned, whereby the disk-like blocking portion 33 is moved into the position shown in the right view of FIG. 5 in which it engages behind a corresponding inwardly projecting portion of the plug-in socket. If the key is pulled out now, the blocking member can no more be removed from the plug-in socket. For removing the blocking member the reversed process takes place, i.e. the key is turned in the opposite direction, whereby the disk-like blocking portion 33 moves again into its initial position shown in FIG. 5 on the left.

Figure 6A:
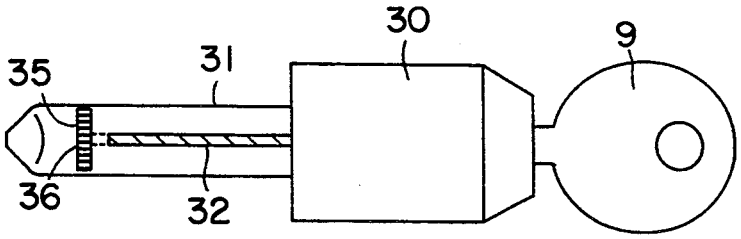
FIGS. 6 and 7 show a schematic view of a last embodiment of a blocking member in its unlocked and locked condition, also without associated plug-in socket.
Figure 6B:
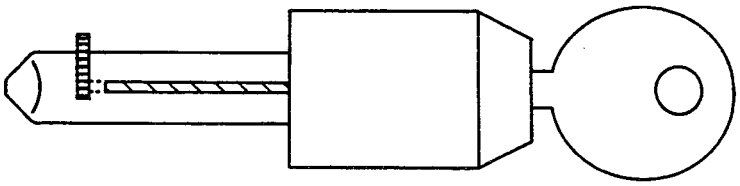
Figure 7:
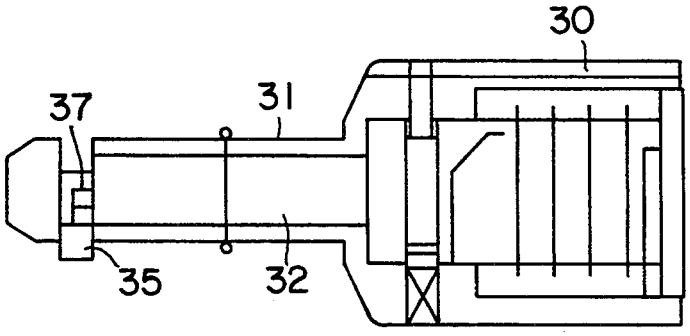

FIGS. 6 and 7 show a last embodiment of the invention. Also in this case only the blocking member without associated plug-in socket is shown. The blocking member 30 has a suitable cylinder lock with lock cylinder which can be actuated by means of a key 9 in the known manner. By turning the key 9 and thus the lock cylinder an elongated actuating member 32 connected to the lock cylinder and located thereon is rotated since a projection 37 excentrically located with respect to the axis is disposed at the forward end of the actuating member. This projection is rotatably located in a correspondingly adapted recess of a pin 35 which is guided within a corresponding bore of a tube 31 which is centrally located at the lock and consists of plastics, for example. The elongated element 32 extends centrally into a corresponding space of the tube 31 either. By turning the key 9 the elongated element 32 is rotated and the pin 35 is moved up and down in accordance with the direction of rotation by means of the excentrically located projection. In the open position the pin is completely located within the tube 31, while it projects from the tube in the closed or blocked position and prevents pulling out the blocking member.

I claim:

1. A plug-in socket for amplifiers, loudspeakers boxes, and electrical musical instruments, comprising a socket member with a round inner bore and having an opening therein for receiving an electrical plug, a housing member located behind said socket member, and being attached to said socket member by a step, said housing member having at least two contact clamps therein, a blocking member partially insertable into said opening of said socket member, said blocking member including a lock housing, a tubular member extending from said lock housing and passing through said round inner bore of said socket member, said tubular member being closely supported within said round inner bore of said socket member thereby securing a fixed central position of said blocking member within said inner bore of said socket member, a rotatable elongated actuating member extending centrally through said tubular member and having a projecting member at a forward end thereof, said projecting member being disposed eccentrically with respect to a longitudinal axis of said elongated actuating member, and a movable pin supported on said tubular member which is engaged by said projecting member, so that when said pin is in a first position, said pin is completely within said tubular member, and when said actuating member is rotated, said pin is moved by said projecting member into a second position wherein said pin is at least partially outside of said tubular member and will engage against said step, thereby preventing removal of said blocking member from said socket member.

2. The plug-in socket of claim 1 further comprising a key which rotates said actuating member.

3. The plug-in socket of claim 1 wherein said projecting member engages into a recess of said pin.

* * * * *